United States Patent [19]

Nishimori et al.

[11] Patent Number: 4,812,877

[45] Date of Patent: Mar. 14, 1989

[54] COPYING APPARATUS WITH MULTIPLE COPY MODES

[75] Inventors: Kadotaro Nishimori, Toyokawa; Masazumi Ito, Toyohashi; Masaaki Oyabu, Aichi, all of Japan

[73] Assignee: Minolta Camera Kubushiki Kaisha, Osaka, Japan

[21] Appl. No.: 96,612

[22] Filed: Sep. 11, 1987

[30] Foreign Application Priority Data

Sep. 13, 1986 [JP] Japan ..... 61-216192

[51] Int. Cl.[4] ..... G03G 15/00

[52] U.S. Cl. ..... 355/14 R

[58] Field of Search ..... 355/3 SH, 14 SH, 14 R, 355/14 C, 23–26, 4, 8

[56] References Cited

U.S. PATENT DOCUMENTS 4,218,130 8/1980 Satomi et al. ..... 355/24 X
4,327,994 5/1982 Barley ..... 355/14 R
4,537,497 8/1985 Masuda ..... 355/14 R
4,579,443 4/1986 Abuyama et al. ..... 35.5/4
4,723,148 2/1988 Hamakawa ..... 355/14 SH

FOREIGN PATENT DOCUMENTS 59-152460 8/1984 Japan ..... 355/14 SH

OTHER PUBLICATIONS

U.S. Serial No. 832,470 (02/19/86), Hamakawa.

*Primary Examiner*—Arthur T. Grimley
*Assistant Examiner*—J. Pendegrass
*Attorney, Agent, or Firm*—Price, Gess & Ubell

[57] ABSTRACT

The present invention relates to a copying apparatus capable of executing various copying operations. The copying apparatus has a first key for designating a format of an original document to be copied and a second key for designating a format of a copy to be formed and forms the image of the original document on a copy sheet in the designated format.

6 Claims, 11 Drawing Sheets

COPYING APPARATUS WITH MULTIPLE COPY MODES

BACKGROUND OF THE INVENTION

1. Field of the Invention

The present invention relates to a copying apparatus having a plurality of copy modes.

2. Prior Art

Electrophotographic copy machines have been developed in recent years which have a plurality of various copy mode functions in addition to the conventional copying function (single-sided copying). These additional copying functions include, for example, two-sided copying wherein copying is performed to both the obverse and reverse sides of a copy paper, composite copying wherein copying is performed with different images (borders and characters within borders, for example) and different colored toners to one side of the copy paper, and dual-page copying wherein an opened book is placed on the original document glass platen and the texts of right and left facing pages are scanned and copied sequentially to two sheets of copy paper by starting a single copying operation.

Furthermore, three types of original documents have been considered, for example: single-sided originals having an image on only one side, two-sided originals having images on both, and open-faced books having images on consecutive nine combinations have been considered which the original document type and each of the copying in a copying apparatus having the aforesaid three functions, said nine copying functions being described.

Single-sided original →Single-sided copy
Single-sided original →Two-sided copy
Single-sided original →Composite copy
Two-sided original →Single-sided copy
Two-sided original →Two-sided copy
Two-sided original →Composite copy
Book original →Single-sided copy
Book original→Two-sided copy
Book original →Composite copy Several disadvantages arise when these nine copy operation combinations are performed using independent mode-setting keys for each mode, i.e., a great number of keys are the operation becomes increasingly complex, and swift mode setting becomes impossible.

SUMMARY OF THE INVENTION

A principal object of the present invention is to provide a copying apparatus having a plurality of copy modes and simple mode settings.

Another object of the present invention is to provide a copying apparatus having a plurality of copy modes with a minimum number of mode-setting keys.

The aforesaid objects are fulfilled by a copy machine which specifies the copy machine operation mode by means of a single first assignment key for setting the copy process and a single second assignment key for setting the original document type.

BRIEF EXPLANATIONS OF THE DRAWINGS

These and other objects and features of the present invention will become apparent from the following description taken in conjunction with the preferred embodiments thereof with reference to the accompanying drawings, in which:

FIG. 1 is a cross section view of the general structure of the copying machine.

FIGS. 2(*a*), 2(*b*), 2(*c*) and 2(*d*) are drawings which explain the dual-page copying function.

Figure 10A:
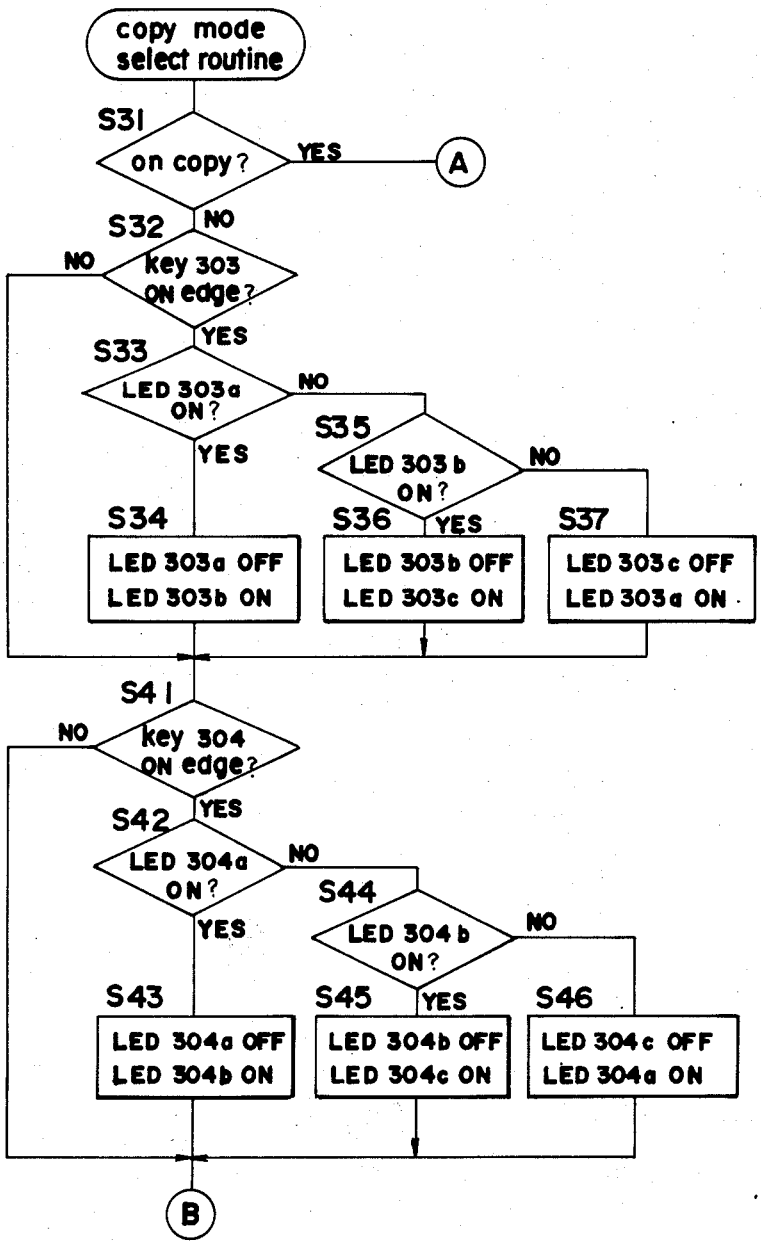
Figure 10:
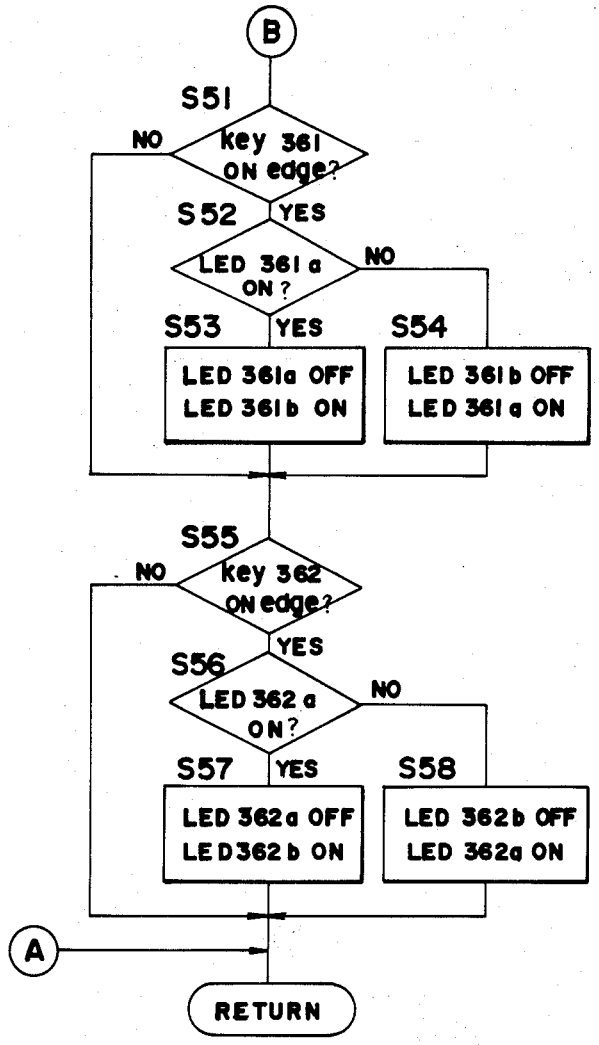

FIG. 10(*a*) and 10(*b*) are flow charts showing the details of the copy mode selection routine of the other embodiment.

DETAILED DESCRIPTION OF THE PREFERRED EMBODIMENTS

Embodiments of the present invention are described in the following sequence and with reference to the accompanying drawings.

(a) Copying machine construction
(b) Two-sided and composite copying
(c) Dual-page copying
(d) Control panel
(e) Control circuit
(f) Control processes
(g) Copy mode selection
(h) Copy mode encoding
(i) Modified embodiments

(a) Copying Machine Structure

First, the general construction of a copying machine related to the present invention will be explained together with its copying operations.

A copy machine of the present invention is capable of two-sided and composite copying by feeding the copy paper to an intermediate tray unit (A) after making the first copy and then re-feeding the copy paper because said copying machine comprises an optical system in the top portion and, in the bottom portion, a copy paper storage section and a paper feed section, an intermediate tray unit A immediately above said copy paper storage section, and an image transfer section having located in a center position a photosensitive drum 2 provided thereto.

Photosensitive drum 2 is rotatable in the direction indicated by arrow (a), and provided circumferentially thereto are, sequentially, a sensitizing charger 6, magnetic brush developing unit 3, transfer charger 5*a*, separating charger 5*b*, blade-type cleaning device 4, and an eraser lamp 7. As photosensitive drum 2 rotates in the direction of arrow (a) it is uniformly charged by sensitizing charger 6 and receives an image exposure from the optical system 1 whereby an electrostatic latent image is formed thereon, said electrostatic latent image being developed into a toner image by means of developing unit 3.

Optical system 1 scans in the direction indicated by arrow (b) beneath the original document glass platen 16, and comprises an exposure lamp 10, movable mirrors 11*a*, 11*b* and 11image forming lense 12, and stationary mirror 11*d*. Exposure lamp 10 and movable mirror 11*a* are so driven as to travel together in the direction of arrow (b) at a speed (V/m, where m is the copying magnification) relative to the peripheral speed V of photosensitive drum 2 (V is constant and independent of variations in magnification), and movable mirrors 11*b* and 11*c* travel in the direction of arrow (b) at speeds of V/2 m.

Copy paper storage comprises an upper level elevator-type storage 42 and lower level storage 43. Copy paper within paper storage 42 and 43 is fed via the rotation of paper roller 18 and 19, respectively, selectively guided therefrom sheet by sheet via guide rollers 20 and 21 or 22 and 23, respectively, and fed to timing roller set 13 by feed rollers 29, 30, 31, 24, 25, 26, 27, 28 and 32 and 34. The copy paper is temporarily stopped by a timing roller 13 and thereafter delivered to the transfer station in timed relation with the image formed on the aforesaid photosensitive drum 2, and the toner image is transferred to the paper by the transfer charger 5*a*, whereupon the paper is separated from the surface of photosensitive drum 2 by means of a separating charger 5*b* and fed to a fixing unit 9 by feed belt 8 provided with air suction means 8*a*, and the toner image is fused to the paper.

Immediately behind the exit point from fixing unit 9 are provided feed roller set 14 and discharge roller set 15 with a lever 41 provided therebetween for the purpose of switching the copy paper feed path. When the copy paper is discharged from fixing unit 9, the lever 41 is set in the position described by the dotted lines in FIG. 1 and the paper exiting the fixing unit 9 is discharged to tray 36 from discharge roller set 15. Or when two-sided copies or composite copies are made, lever 41 is set in the position described by the solid lines and the copy paper transits guide plate 37 from feed roller set 35 and is fed into the intermediate tray unit A.

Following the image transfer, photosensitive drum 2 is ready for the next copy after residual toner is removed from the drum via cleaning device 4 and residual charges are removed via exposure to the light from eraser lamp 7.

Auto document feeder 400 (hereinafter referred to as ADF), which automatically sets the original document at a specific position on document glass platen 16, is provided on original document platen 16. ADF 400 comprises an A unit having an original document feeder tray 411 and a paper roller 402, a DF unit 420 having a feed belt 421, switching claw 422 and document output tray 423, and an R unit 430.

A single-sided original document which is placed on the document feeder tray 411 of A unit 410 is delivered to the DF unit 420 sheet by sheet via paper roller 412. The document delivered from A unit 410 is set at the specified position on document platen 16 by means of feed belt 421. After scanning by optical system 1, the document on glass platen 16 is discharged to document output tray 423 guided by switching claw 422.

In the case of two-sided original documents, the document is first fed directly to the R unit 430 via feed belt 421 following discharge from A unit 410, and then the document is inverted. The inverted document is then set at a specified position on document glass platen 16 by means of feed belt 421 and a first scanning is performed on the first side. After scanning is completed, the document is again delivered to R unit 430 and inverted, and the second side is set at the specified position on document platen 16 and a second scanning is performed on the second side. After scanning is completed, the document is discharged to the document output tray 423 in the same way as the single-sided document.

The DF unit 420 attaches to document platen 16 in such a way that an operating adjustment allows it to open. In the case of a book original, the DF unit 420 is opened and the book is placed on platen 16 and copied. The ADF 400 cannot operate when the DF unit 420 is in the open position.

(b) Two-sided and Composite Copying

An explanation of two-sided and composite copying which utilizes intermediate tray unit A follows hereinafter.

Intermediate tray unit A comprises a switching block, feed block, inverter block, aligning/intermediate tray block, and paper re-feed block.

The switching block consists of feed rollers 50 and 51 and a switching lever 59. Switching lever 59 is switched depending on whether or not the paper is to be inverted. This switching block need not be attached to the intermediate tray unit A, but can be attached to the body of the copy machine.

The feed block comprises feed rollers 52, 53, 54 and 55 and guide plates 86 and 87; the feed block feeds the paper during two-sided copying.

The inverter block consists of inverter feed rollers 56 and 57 and an inverter guide not shown in the drawing. The inverter block has the function of inverting paper fed to it by the feed block, then feeding said paper to intermediate tray 58.

The aligning/intermediate tray block comprises an intermediate tray 58, slide track 77, slide members 73 and 79 and a regulating plate not shown in the drawing. The aligning/intermediate tray block has the function of coordinating the paper fed to intermediate tray 58.

The paper re-feed block consists of a holder not shown in the drawing, paper re-feed roller, guide roller, and a guide plate not shown in the drawing. The paper re-feed block re-feeds, sheet by sheet, the copy paper which has been aligned in the intermediate tray.

Figure 1:
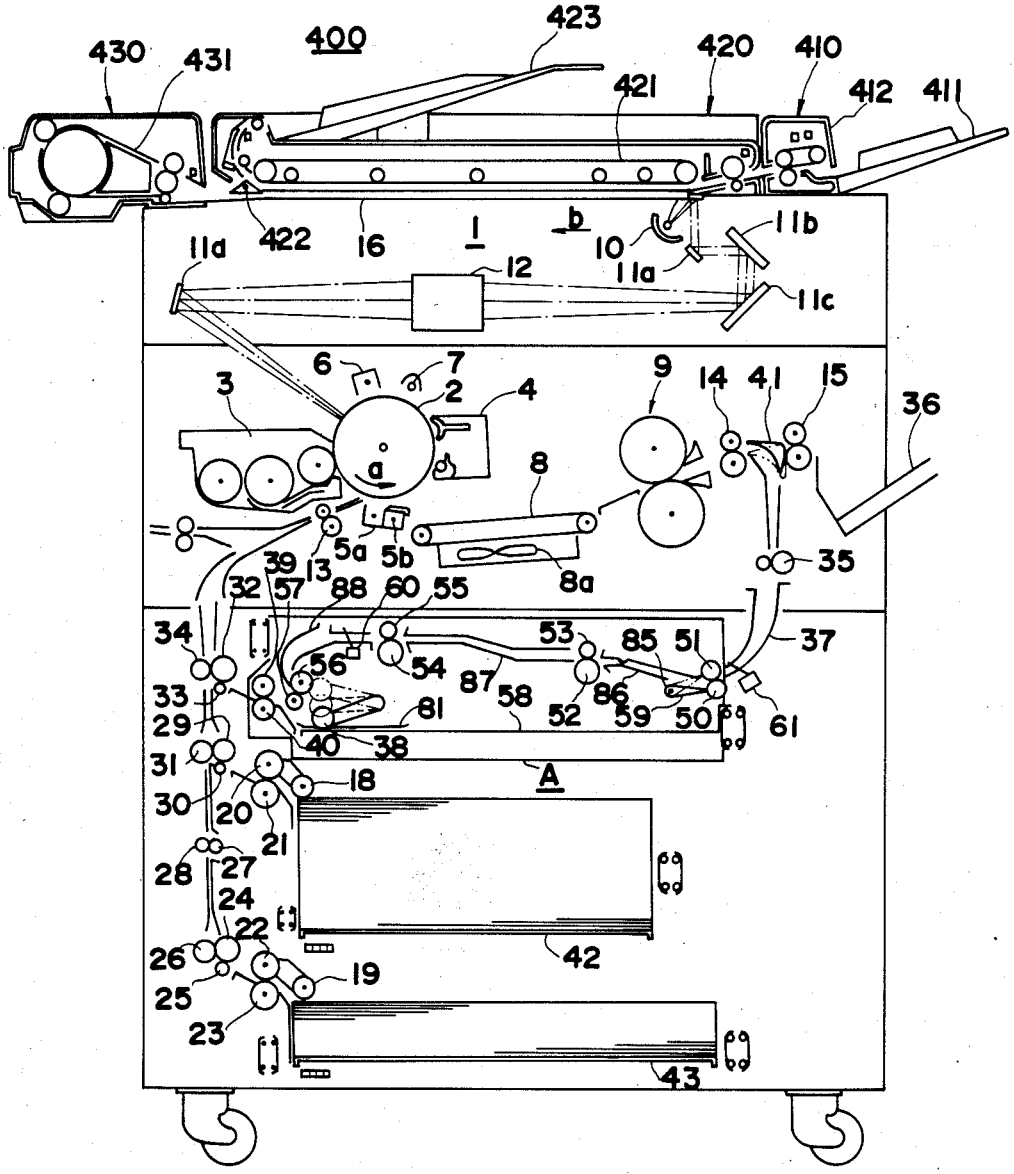

In two-sided and composite copying, after either of the copy modes is pre-selected by pushing the document and copy selection keys 303 and 304 located on the control panel (refer to FIG. 3), switching lever 41 is switched to the position described by the solid lines in FIG. 1 and the copy paper which has already been copied on one side is fed from feed roller set 35 to feed rollers 50 and 51 guided by guide plate 37.

The switching lever 59 has axis 85 as a fulcrum point and is position adjustable; during two-sided copying, this lever is set in the position indicated by the solid lines in FIG. 1. Copy paper is guided by the top face of said switching lever 59 and fed to the feed block, and thence to the left side as shown in FIG. 1 by feed rollers 52,53, 54 and 55 while guided by guide plates 86 and 87, whereupon the paper is inverted by means of inverting rollers 56 and 57 and inverting guide 88, then fed to intermediate tray 58 with the copy-lacking side on top. Thereupon, the paper is aligned on the intermediate tray 58 by the aligning mechanism and re-fed sheet by sheet via the counterclockwise rotation of paper re-feed roller 88.

During composite copying, however, the aforesaid switching lever 59 is set in the position described by the dotted lines in FIG. 1. Immediately after the copy paper traverses feed rollers 50 and 51, it is fed to the top of the directly connected intermediate tray 58 guided by the underside of lever 59 with the copy-lacking side face-down. Thereupon, the copy paper is aligned in intermediate tray 58 by means of the paper aligning mechanism (for details refer to U.S. patent application Ser. No. 875,870 filed on June 18, 1986) and re-fed sheet by sheet via the counterclockwise rotation of paper re-feed roller 38 in the same manner as for two-sided copying.

Re-fed copy paper transits feed rollers 32, 33 and 34 guided by guide rollers 39 and 40 and is fed to timing roller set 13 for two-sided and composite copying in substantially the same manner as the normal copying process performed thereafter.

(c) Dual-page Copying

An explanation of dual-page copying of two-paged original documents and the book dual-page copy mode in particular follows hereinafter with reference to FIGS. 2(*a*) and 2(*b*).

Figure 2:
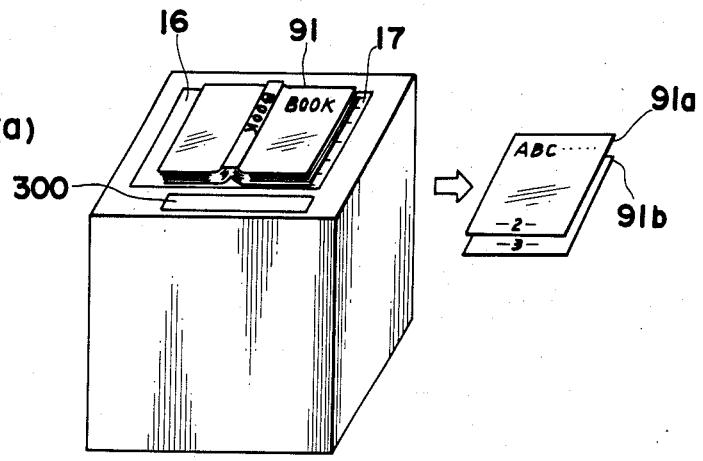
Figure 2:
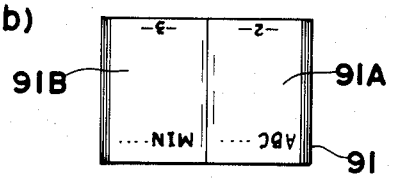
Figure 2:
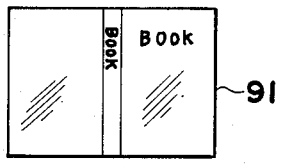
Figure 2:
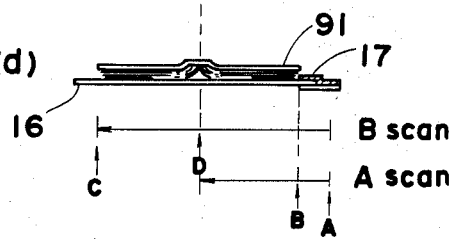

In this copy mode, when a book 91 is positioned open-faced on original document platen 16 with its right edge abutting the document scale 17, as shown in FIG. 2(*a*), the two facing pages of said book 91 can be copied one page at a time to two separate copies 91*a* and 91*b* in a single operation of the print key 301.

As can be understood by referring to the output copies 91*a* and 91*b* of FIG. 2(*a*) and FIGS. 2(*b*), 2(*c*) and 2(*d*), the copies are regulated so that the third page of book 91, i.e., page 91B having the letters "MIN" written thereon (the page on the left-hand side is hereinafter referred to as side B), is copied by the initial scan, and the second page of book 91, i.e., page 91A having the letters "ABC" written thereon (the page on the right-hand side is hereinafter referred to as side A), is copied by the subsequent scan. The initial scan is labeled B-scan and the subsequent scan is labeled A-scan; book 91 is an A4 size impression.

In the B-scan, as shown in the explanatory drawing of FIG. 2(*d*), the copy paper feed is regulated so that the edge of the fed copy paper aligns with point D which is located on an A4-sized scanned area from point B, then the side B (91*b*) of the book is copied by a scan from point D to point C. Next, the scanner (10, 11*a*, 11*b*, 11*c* and 11*d* in FIG. 1) reverses and returns to point A, and in the A-scan, the copy paper feed is regulated so that the edge of the fed paper aligns with point B in the same manner as for the normal copy operation. In the A-scan, scanning is completed at a distance the size of book surface A (91A), i.e., the A4-size area from point B to point D. The output copies are output in the order of side B, side A, as shown in FIG. 2(*a*).

(d) Control Panel

Figure 3:
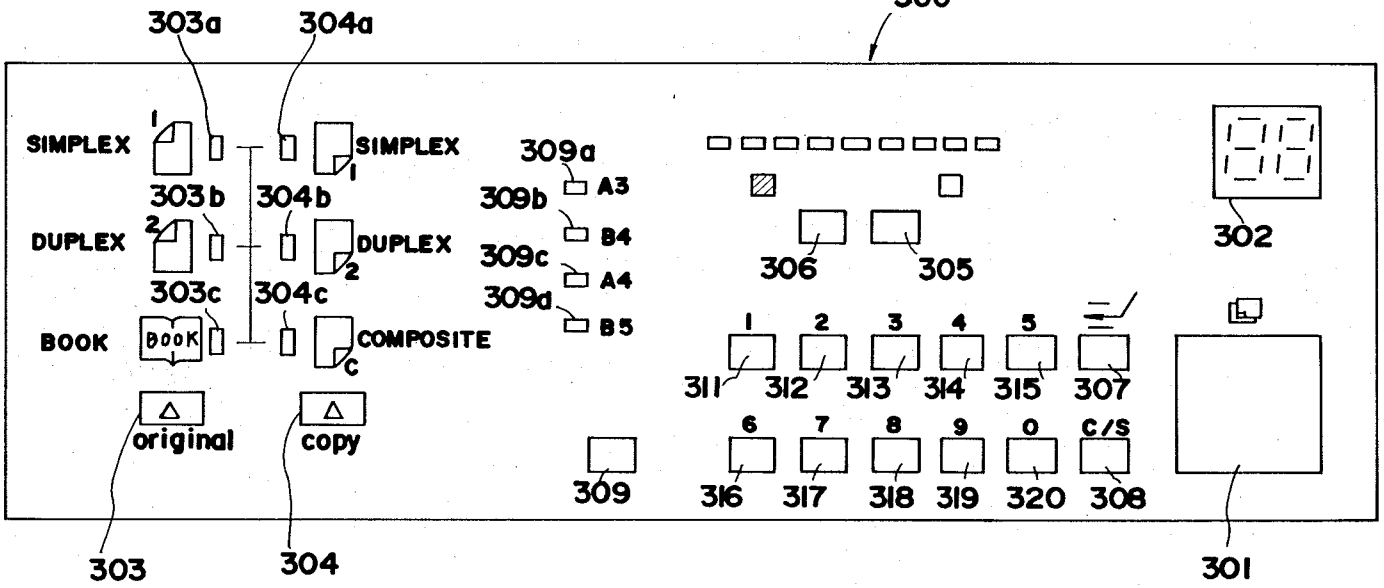
FIG. 3 is a drawing showing the key layout of the control panel.

FIG. 3 shows the layout of each type of operation key on the control panel 300 of the copying machine.

The following keys are arranged on the control panel 300: a print key 301 for starting the copying operation, ten numerical keys 311 to 320 corresponding to the ten numerical values of "1," "2," . . . "9" and "0," respectively, an interrupt key 307 for specifying interrupted copying, clear/stop key 308, paper selection key 309 for specifying paper storage stage 42 and 43, and up and down keys 305 and 306 for varying the the copy image density step-wise and specifying the desired density. Also, an original document selection key 303 for selecting the document type and copy selection key 304 for selecting the copy type are arranged on the left side of the panel.

In addition to a copy counter display device 302 capable of displaying two-digit numerical values, the following display devices are arranged on the control panel above the paper selection key 309: LEDs 309*a*, 309*b*, 309*c* and 309*d* which indicate the sizes of copy paper supplied from the paper storage sections, respectively, A3, B4, A4 and B5. LEDs 303*a*, 303*b* and 303*c* are also arranged in a single vertical column above document selection key 303. LED 303*a* indicates the selection of a one-sided original, LED 303*b* indicates the selection of a two-sided original, and LED 303*c* indicates selection of a book original. Additionally, LEDs 304*a*, 304*b* and 304*c* are arranged in a single vertical column above copy selection key 304. LED 304*a* indicates the selection of a single-sided copy, LED 304*b* indicates the selection of a two-sided copy, and LED 304*c* indicates the selection of a composite copy. Descriptive icons and labeled key descriptions are provided horizontally beside each of the LEDs 303*a* to 303*c* and LEDs 304*a* to 304*c*.

The document selection key 303 and the copy selection key 304 are rotation keys, i.e., when the document selection key 303 is depressed, the document type is sequentially selected in the order: one-sided→ two-sided→ book→ one-sided, and the LED indicators 303*a* to 303*c* are illuminated in correspondence with the selected document type. Likewise, when the copy selection key is depressed, the copy type is sequentially selected in the order: one-sided→ two-sided→ composite→ one-sided, and the LED indicators 304*a* to 304*c* are illuminated in correspondence with the selected copy type.

An explanation of the operating process when the book document/two-sided copy mode is set is given herein as a single example. First, the document type is set. When selection key 303 is depressed, the desired book document setting is selected by the rotation selection of LEDs 303*a* to 303*c*, Then, the copy type is set. The desired two-sided copy setting is selected by the rotational selection of LEDs 304*a* to 304*c* (one-sided copy, two-sided copy, composite copy) each time the copy selection key 304 is depressed.

In the present embodiment the aforementioned input formula (matrix selection formula) is adopted for establishing the document type mode and desired copy type mode, respectively. Thus, fewer LED indicators and a fewer keys are required and a cost reduction can be achieved. Also, a rotational selection formula is adopted which, accordingly, makes for a clear input method whatever copy mode is set because the operation keys are identical. Furthermore, the default copy mode when the power source is turned ON and the auto-clear is activated is a one-sided document/one-sided copy mode setting wherein the LED 303*a* and LED 304*a* are illuminated.

A method whereby a default copy mode of one-sided document/one-sided copy is selected without LED illumination is considered as an alternative formula. This method has an advantage in that when the standard one-sided document/one-sided copy mode is activated in the default mode with none of the indicators illuminated, the unnecessarily illuminated indicators are eliminated and the control unit becomes less complicated.

(e) Control Circuit

Figure 4:
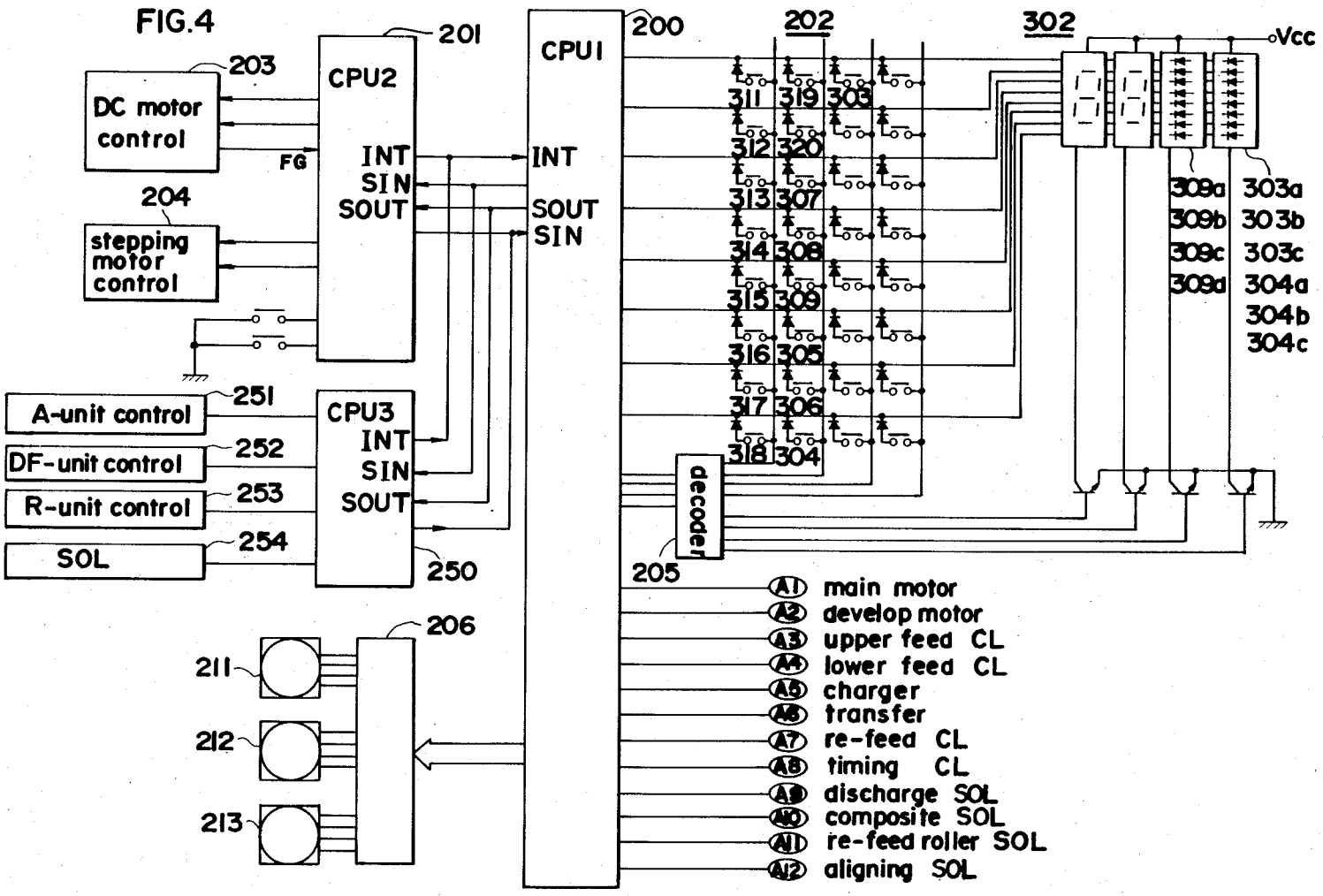
FIG. 4 is a control circuit diagram for the copying machine.

The control circuit of a copying machine of the present embodiment is explained hereinafter with reference to FIG. 4.

The control circuit centrally comprises a first microcomputer 200 for controlling the copying operation, a second microcomputer 201 for controlling the optical system, and a third microcomputer 250 for controlling the ADF which are interconnected for mutual synchronicity. The first CPU 200 has a switch matrix 202 connected thereto in a vertical and horizontal arrangement of each type of sensor and operation key on control panel 300. The first CPU output terminals A1 through A12 are connected thereto to a main motor, developing motor, timing roller clutch, toner resupply motor, upper and lower paper feed clutches, paper re-feed clutch, levers 41 and 59 switching solenoids, and the like, said output terminals controlling the ON/OFF status of each component based on the signals from switch matrix 202. Additionally, the first CPU 200 has connected thereto via a decoder 205 light-emitting diodes (LEDs) for each function including a copy number indicator sector 302, paper size indicators 309*a* to 309*d*, original document type indicators 303*a* to 303*c*, copy type indicators 304*a* to 304*c*, and the like, said first CPU 200 controlling the illumination functions of said LEDs.

First CPU 200 actuates the stepping motors 211, 212 and 213 for paper alignment via the drive unit 206.

On the other hand, the second CPU 201 has connected thereto a direct current motor drive control sector 203 for optical system scanning, stepping motor drive control sector 204 for the variable magnification lens, optical system 1 fixed position switch $S_o$, timing switch $S_1$, and the like.

The third CPU 250 has connected thereto A-unit control sector 251, DF-unit control sector 252, R-unit control sector 253, and switching claw drive solenoid 254.

(f) Control Processes

An explanation of the control process actuating the aforesaid control circuit follows hereinafter based on the flow chart shown in FIG. 5.

Figure 5:
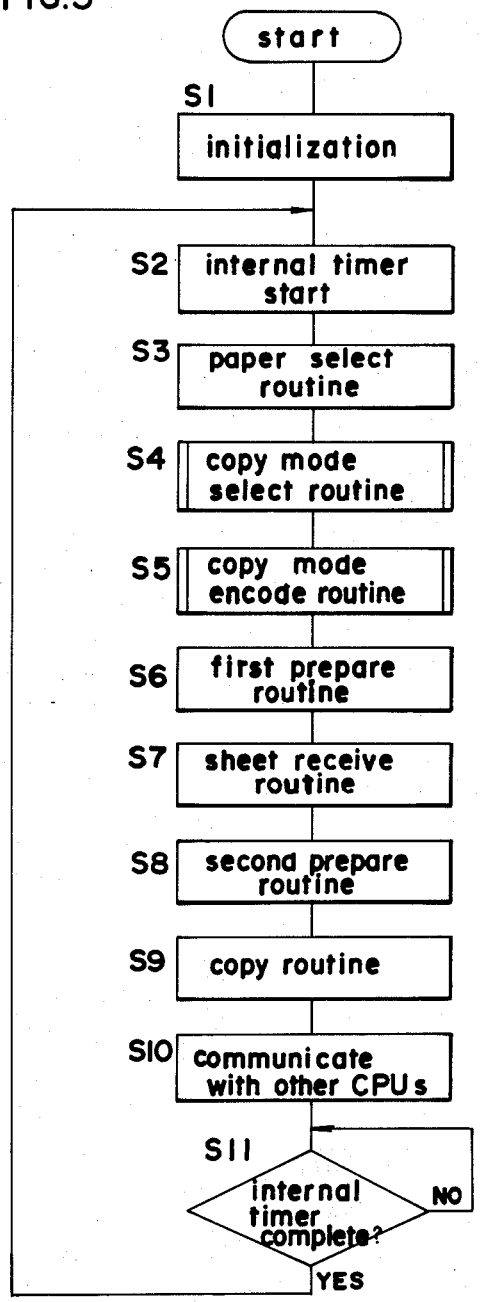
FIG. 5 is a flow chart showing an overview of the copying machine controls.

FIG. 5 shows the main control routines. When power is input, CPUs 200 and 201 are reset and started and in step S1 initialized together with the initialization of each field to the default mode. Then, the internal timer is started in step S2. This internal timer is set in step S1; the set time completion is determined by the counter number of this internal timer for each variety of timer described by the following subroutines so as to establish the processing time of a single routine.

Continuing, each subroutine in steps S3 through S9 are called sequentially and when all subroutine processing is completed the first CPU 200 transmits data to the other CPUs in step S10, then the completion of the aforesaid internal timer is awaited in step $S_{11}$, and the routine returns to step S2.

Step S3 is a paper selection routine for selecting the desired copy paper size. The paper supply section selected by paper selection key 309 and the paper size code is fed to the first CPU 200 and the corresponding indicator LEDs 309*a* through 309*d* are illuminated.

Step S4 is a copy mode selection routine which is explained in detail hereinafter.

Step S5 is a copy mode encoding routine for creating a code corresponding to the selected copy mode, and which is explained in more detail hereinafter.

Step S6 is a first copy preparation routine for preparing the input to intermediate tray A of copy paper already copied on one side for the purpose of two-sided or composite copying.

Step S7 is a sheet receive routine for preliminary alignment of copy paper each time said paper is fed sheet by sheet to intermediate tray A during the copying operation.

Step S8 is a second code preparation routine for preparing paper re-feed for two-sided and composite copies.

Step S9 is a copy actuation routine for carrying out the copy operation in accordance with the selected copy mode.

(g) Copy Mode Selection

Figure 6:
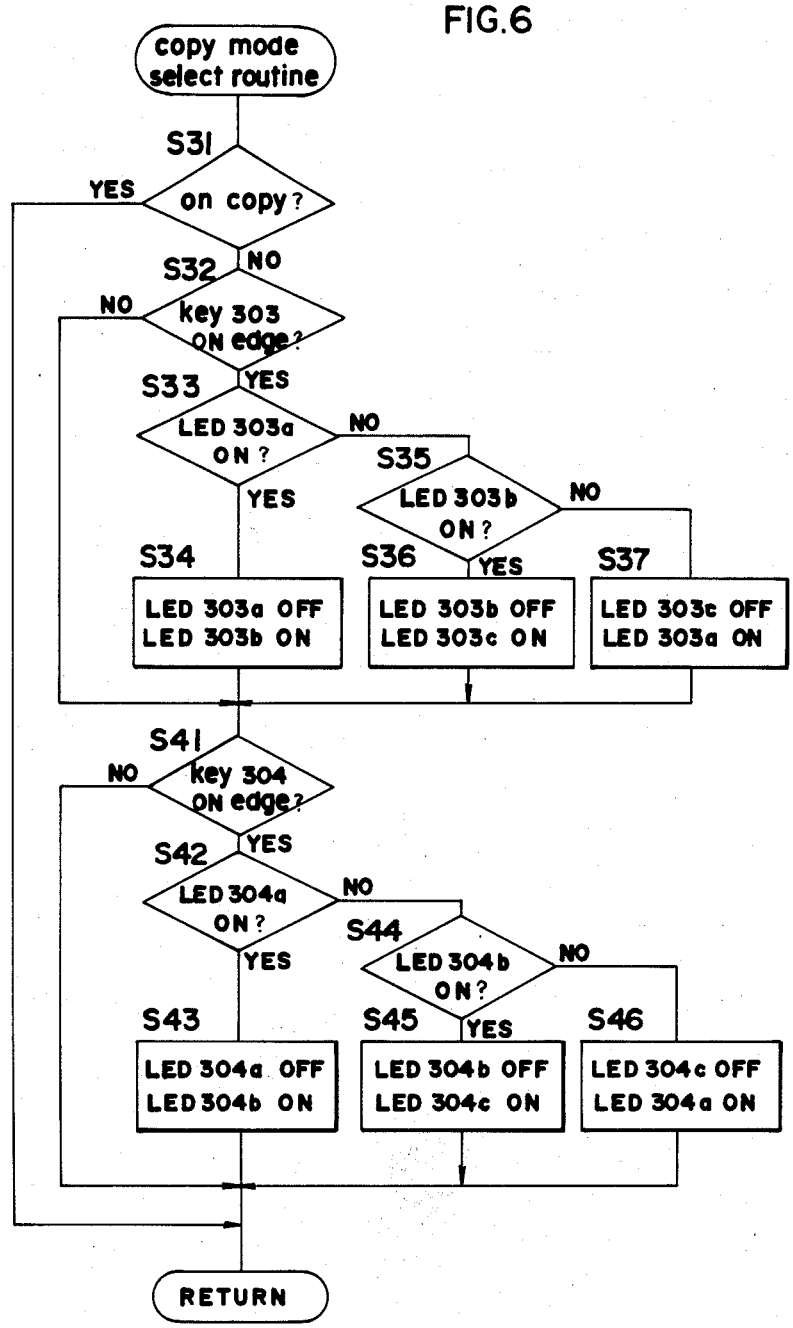
FIG. 6 is a flow chart showing details of the copy mode selecting routine.

FIG. 6 shows the copy mode selection routine. First, a check is performed to determine whether or not a copying operation is in progress (step S31), and if so, the routine is completed.

When a copying operation is not in progress (step S31), then the setup for the type of document is input, i.e., the ON-edge status of the original document type selection key 303 is checked (step S32) and if the ON-edge status is confirmed, first of all, a check is made to determine whether or not LED 303*a* is ON (step S33). If said LED 303*a* is ON, it is switched OFF and LED 303*b* is switched ON (step S34). In step S33, if LED 303*a* is OFF a check is made to determine whether or not LED 303*b* is ON (step S35); if ON, LED 303*b* is switched OFF and LED 303*c* is switched ON (step S35). In step S35, if LED 303*b* is OFF, LED 303*c* is switched ON and when LED 303*c* is switched OFF LED 303*a* is switched ON (step S57). If the ON-edge status of key 303 is not confirmed in step S32, the routine continues to step S41.

In step S41 and thereafter, the copy type is set and input. First, the On-edge status of copy type selection key 304 is checked (step S41), and if ON-edge status is confirmed a check is made to determine whether or not LED 304*a* is ON (step S42). If ON, LED 304*a* is switched OFF and LED 304*b* is switched ON (step S43). If LED 304*a* is switched OFF in step S42, then a check is made to determine whether or not LED 304*b* is ON in step S44, and if ON, LED 304*b* is switched OFF and LED 304*c* is switched ON (step S45). If the check is negative in step S44, it indicates that LED 304*c* is currently ON, so it is switched OFF and LED 304*a* is switched ON (step S46).

According to the aforesaid account, two LEDs are illuminated corresponding to the set copy mode by means of the operation of the document selection key 303 and the copy selection key 304. Thus, the copy mode can be established by the two illuminated LEDs.

(h) Copy Mode Encoding

Figure 7:
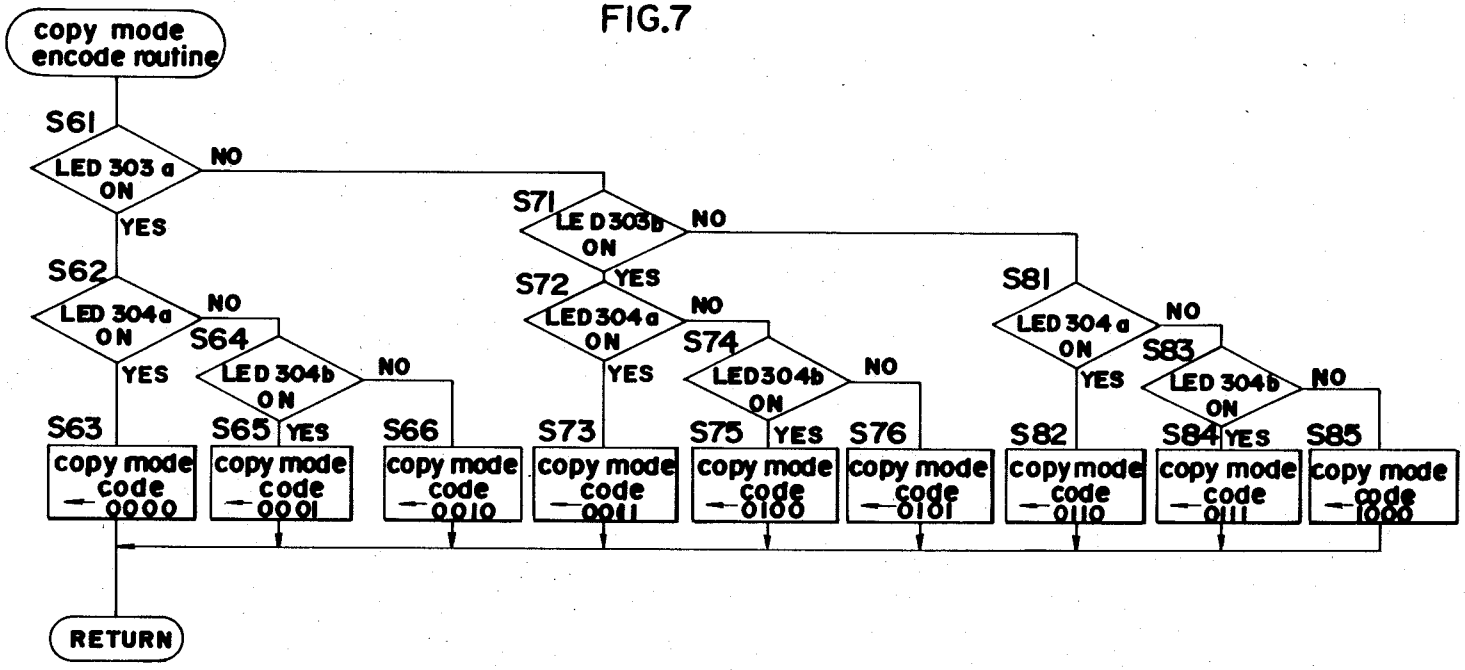
FIG. 7 is a flow chart showing details of the copy mode encode routine.

FIG. 7 shows the copy mode code routine (step S5) for creating a code which corresponds to the copy mode set by the copy mode selection routine (step S4). A copy mode code which corresponds to the selected copy mode is shown in Table 1.

TABLE 1

| Copy Mode | Code |
|---|---|
| One-sided original → One-sided copy | 0000 |
| One-sided original → Two-sided copy | 0001 |
| One-sided original → Composite copy | 0010 |
| Two-sided original → One-sided copy | 0011 |
| Two-sided original → Two-sided copy | 0100 |
| Two-sided original → Composite copy | 0101 |
| Book original → One-sided copy | 0110 |
| Book original → Two-sided copy | 0111 |

TABLE 1-continued

| Copy Mode | Code |
|---|---|
| Book original → Composite copy | 1000 |

First, a check is made to determine whether or not LED 303*a* is ON (step S61). If said LED 303*a* is ON, the document type is established to be one-sided. Next, a check is made to see if LED 304*a* is ON (ON) (step S62) and if so, the copy mode code is set at 0000 (step S63) because the set mode is a one-sided original to one-sided copy. In step S62, if LED 304*a* is OFF, then a check is made to establish whether or not LED 304*b* is ON (step S64). If said LED 304*b* is ON, the copy mode code is set at 0001 (step S65) because the set mode is a one-side original to two-sided copy. If LED 304*b* is OFF in step S64, LED 304*c* is a ON and the copy mode code is set at 0010 (step S66) because the set mode is a one-side original to composite copy.

If LED 303*a* is not ON in step S61, LED 303*b* is checked to determine whether or not it is ON (step S71). If said LED 303*b* is ON, the document type is established to be two-sided. Next, a check is run to determine whether or not LED 304*a* is ON (step S72), and if so, the mode is a two-sided original to one-sided copy and the copy mode code is set at 0011 (step S73). If LED 304*a* is OFF in step S72, then, a check is made to determine whether or not LED 304*b* is ON (step S74), and if so, the copy mode code is set at 0100 (step S75) because the set mode is a two-sided original to two-sided copy. In step S74, LED 304*c* is ON when LED 304*b* is OFF, and the copy mode code is set at 0101 (step S76) because the set mode is a two-sided original to composite copy. If LED 303*b* is OFF in step S71, LED 303*c* is ON and the original document is determined to be a book type. Next, a check is made to determine whether or not LED 304*a* is ON (step S81). If LED 304*a* is ON the copy mode code is set at 0110 (step S82) because the set mode is a book original to one-sided copy. When LED 304*a* is OFF in step S81, a check is made to determine whether or not LED 304*b* is ON (step S83). If LED 304*b* is ON the mode is a book original to two-sided copy and the copy mode code is set at 0111 (step S84). LED 304*c* is ON when LED 304*b* is OFF in step S83, and the copy mode code is set at 1000 (step S85) because the set mode is a book original to composite copy.

According to the aforesaid explanation, control of these copy mode code determinations allows superior performance of each sector because the codes are set separately from the copy modes.

Figure 8:
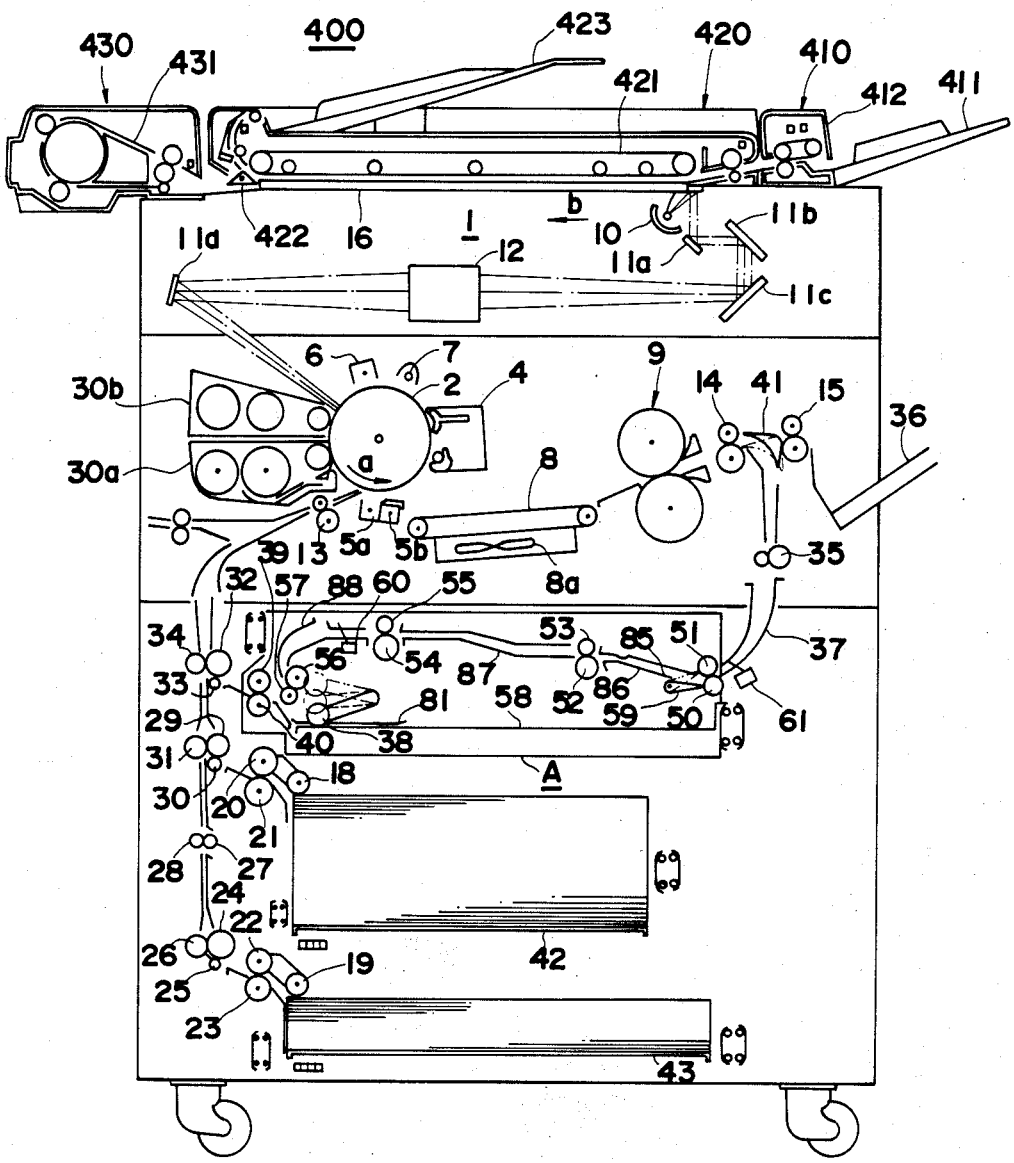
FIG. 8 is a cross section view showing the general copying machine structure of another embodiment.
Figure 9:
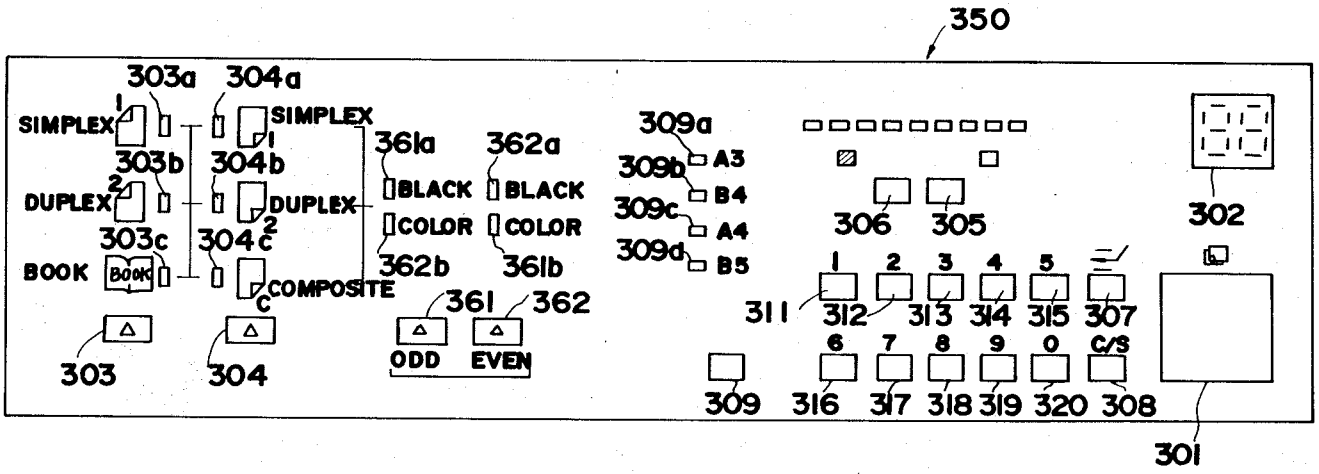
FIG. 9 shows the key layout of the control panel of the other embodiment.

FIGS. 8 to 10 show modified embodiments of the present invention.

The copying machine shown in FIG. 8 comprises a first developing unit 30*a* for supplying black toner, and a second developing unit 30*b* for supplying colored toners other than black, for example, red. Also, the second developing unit 30*b* is removably adjustable from the copying machine body and may be exchanged for another developing unit for supplying colored toners other than red. The description of the copying machine will be brief since the the construction of said copying machine is, other than the developing unit, identical with the construction shown in FIG. 1.

This copying machine has, in addition to the functions described for the aforesaid modified embodiment, the following capabilities:

(1) the colors of the obverse and reverse sides of a copy can be different when copying two-sided originals to two-sided copies, and (2) when copying two one-sided originals to a single one-sided composite, the copy color (developer color) corresponding to the first one-sided original and the color corresponding to the second one-sided original can differ.

FIG. 9 shows the control panel 350 of the aforesaid copying machine. On this control panel 350 are, in addition to the keys shown in FIG. 1, developer color selection keys and an indicator section. The assignment of developer color (toner color, i.e., copy color) for two-sided copying and composite copying is performed via an odd-scan developer color selection key 361 and an even-scan developer color selection key 362 provided adjacently and medial to copy key 304 and paper size selection key 309 so as to allow independent selection of odd-sequence scanning and even-sequence scanning, respectively. LEDs 361*a* and 361*b* which indicate the selected developer color (black or colored, respectively) are provided in a vertical column above the even-scan developer color selection key 361, and similarly, LEDs 362*a* and 362*b* which indicate the selected developer color (black and colored, respectively) are provided in a vertical column above the odd-scan developer color selection key 362.

The developer color selection keys 361 and 362 are rotation selection keys. The default selections for both the even- and odd-scan are black. If the developer color selection key 361 is depressed once, for example, LED 361*a* is switched OFF and LED 361*b* is switched ON and colored developer is selected as the copy color. When said key 361 is depressed once again LED 361*b* is switched OFF and LED 361*a* is switched ON and black is selected as the copy color. The operation is identical when the even-scan developer color selection key 362 is activated.

FIG. 10 shows the copy mode selection routine (scan S4'). A difference by which this routine diverges from the example shown in FIG. 6 is that the developer color selection routine (B in the drawing) has been added. An explanation of the added portion follows hereinafter.

First, an odd-scan developer color is selected. The ON-edge status of the odd-scan developer color selection key 361 is determined (step S51) and if ON-edge status is confirmed, a check is made to determine whether or not LED 361*a* is ON (step S52). If said LED 361*a* is ON it is switched OFF and LED 361*b* is switched ON (step S53). In step S52, LED 361*b* is ON if LED 361*a* is OFF, so LED 361*b* is switched OFF and LED 361*a* is switched ON (step S54).

Next, the ON-edge status of the even-scan developer color selection key 362 is determined step S55) and if ON-edge status is confirmed, a check is made to determine whether or not LED 362*a* is ON (step S56). If said LED 362*a* is ON it is switched OFF and LED 362*b* is switched ON (step S57). In step S56, LED 362*b* is ON if LED 362*a* is OFF, so LED 362*b* is switched OFF and LED 362*a* is switched ON (step S58).

The copy mode can be determined by means of the four LEDs which indicate the selection by the copy mode selection routine explained above. The selected copy mode is encoded and implemented by discrimination of the illuminated LEDs (one LED from each of the respective groups for a total of four: LED 303*a* to 303*c*, LED 304*a* to 304*c* , LED 361*a* and 361*b*, LED 362*a* and 362*b*) from a control standpoint. A color code corresponding to the the copy mode code shown in Table 1 and the color copy mode shown in Table 2 may be encoded. Although color encoding flow chart is not shown separately herein, it is substantially similar to the copy mode encoding routine flow chart shown in FIG. 7, and said encoding is capable of discriminating the illuminated LEDs (one LED from each of the respective groups for a total of two: LED 361*a* and 361*b*, and 362*b*).

TABLE 2

| Copy Mode (Color) | Color Code |
|---|---|
| All Black | 00 |
| All Color | 11 |
| Odd-scan Black | 01 |
| Even-scan Color | |
| Odd-scan Color | 10 |
| Even-scan Color | |

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A copying apparatus comprising:

means for handling original documents of various formats;

means for forming the image of an original document on a copy sheet in various formats;

a first key;

first select means for selecting one of said various document formats in response to the actuation of said first key;

a second key;

second select means for selecting one of said various copy formats in response to the actuation of said second key; said first select means selects one of said document formats irrespective of said second key, and said second select means selects one of said copy formats irrespective of said first key;

encode means for creating a copy mode code corresponding to a copy mode defined by said first select means and second select means, and means for controlling said document handling means and said image forming means based on the copy mode code created by said encode means.

2. A copying apparatus as claimed in claim 1, further comprising:

first display means for displaying the original document format selected by said first select means; and second display means for displaying the copy format selected by said second select means.

3. A copying apparatus as claimed in claim 1, wherein said original document formats include a simplex format and a duplex format.

4. A copying apparatus as claimed in claim 1, wherein said copy formats include a simplex format, a duplex format and a composite format.

5. A copying apparatus comprising:

a document table for supporting an original document to be copied;

means for scanning the original document and exposing the image of the original document onto a photosensitive member in various scanning modes;

means for forming a toner image and transferring the toner image on a copy sheet in various image forming modes;

a first key;

first means for designating one of said scanning modes in response to the actuation of said first key;

a second key;

second means for designating one of said image forming modes in response to the actuation of said second key; said first means selects one of said scanning modes irrespective of said second key, and said second means selects one of said image forming modes irrespective of said first key;

encode means for creating a copy mode code corresponding to a copy mode defined by said first designating means and second designating means, and means for controlling said scanning means and image forming means based on the copy mode code created by said encode means.

6. A copying apparatus comprising:

a first key;

first means for designating the format of an original document to be copied in response to the actuation of said first key;

a second key;

second means for designating the format of a copy to be formed in response to the actuation of said second key;

a third key;

third means for designating the color of a copy to be formed in response to the actuation of said third key; said first means designates the format of the original document irrespective of said second and third keys, said second means designates the format of the copy irrespective of said first and third keys, and said third means designates the color of the copy irrespective of said first and second keys;

encode means for creating a copy mode code corresponding to a copy mode defined by said first, second and third means;

means for forming the image of the original document on a copy sheet, and means for controlling said image forming means based on the copy mode code created by said encode means.

* * * * *